US006416426B1

(12) United States Patent
Nakamura et al.

(10) Patent No.: US 6,416,426 B1
(45) Date of Patent: Jul. 9, 2002

(54) GOLF BALL

(75) Inventors: Atsushi Nakamura; Hisashi Yamagishi; Takashi Maruko, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/487,775

(22) Filed: Jan. 20, 2000

(30) Foreign Application Priority Data

Mar. 3, 1999 (JP) ..... 11-055238

(51) Int. Cl.[7] ..... A63B 37/06
(52) U.S. Cl. ..... 473/378
(58) Field of Search ..... 473/378–385

(56) References Cited

U.S. PATENT DOCUMENTS 5,562,287 A 10/1996 Endo et al. ..... 273/377
5,601,503 A * 2/1997 Yamagishi et al. ..... 473/384
5,607,366 A 3/1997 Yokota et al. ..... 473/372
5,645,496 A * 7/1997 Endo et al. ..... 473/372
5,702,312 A * 12/1997 Horiuchi et al. ..... 473/377
5,776,013 A 7/1998 Yokota et al. ..... 473/377
5,779,564 A * 7/1998 Nakamura et al. ..... 473/377
5,807,192 A * 9/1998 Yamagishi et al. ..... 473/377
5,813,924 A * 9/1998 Yamagishi et al. ..... 473/377
5,820,492 A * 10/1998 Yamagishi et al. ..... 473/377
5,911,639 A * 6/1999 Kasashima et al. ..... 473/377
5,993,332 A * 11/1999 Yamagishi et al. ..... 473/377
6,045,461 A * 4/2000 Yamagishi et al. ..... 473/377

OTHER PUBLICATIONS

English language abstract for each of U.S. Patent Nos. 5,607,366; 5,562,287; and 5,776,013.

* cited by examiner

*Primary Examiner*—Mark S. Graham
*Assistant Examiner*—Raeann Gordon
(74) *Attorney, Agent, or Firm*—Sughrue Mion, PLLC

(57) ABSTRACT

A golf ball comprising a core and a cover has a number of dimples in its surface. The ball, when hit with a driver at a head speed of 50 m/s, has an effective contact area A and an apparent contact area B with the club face such that the ratio A/B is from 0.40 to 0.60. The dimple surface coverage is at least 71%. The ball has fully adequate spin and control characteristics and improved flight performance, and is well suited for use by golfers having a head speed of higher than about 40 m/s.

14 Claims, 1 Drawing Sheet

GOLF BALL

The present invention relates to a golf ball having excellent controllability and improved flight performance.

BACKGROUND OF THE INVENTION

To fulfil the expectations of golf players, efforts are currently made to develop a golf ball that satisfies both the requirements of a longer distance on driver shots and good controllability on approach shots. It is known from such technical development works that the use of a soft cover is effective for improving the spin performance of a golf ball.

With respect to the controllability of a golf ball, it is described in JP-A 9-135923 that the greater the contact area between a club face and a golf ball upon impact, the better becomes the controllability of the ball.

Since these golf balls are developed primarily for improving the controllability and spin performance thereof, they are not necessarily good in flight performance and many balls are rather inferior in flight performance.

It is known from JP-A 9-135923 that the surface coverage of dimples must be reduced in order to increase the contact area of a ball with a club face. In general, a reduced number of dimples on the ball surface fail to exert desired dimple aerodynamics and render it difficult to improve the flight performance of the ball. It is then desired to have a golf ball which is improved not only in spin and controllability by increasing the contact area of the ball with a club face upon impact, but also in flight performance by taking advantage of dimple aerodynamics.

SUMMARY OF THE INVENTION

It is therefore an object of the invention to provide a golf ball which has fully adequate spin characteristics and controllability as well as improved flight performance.

It has been found that when a golf ball is formed in its surface with dimples so as to optimize the ratio A/B between the effective surface area of contact A and the apparent surface area of contact B by the golf ball with the club face when the ball is hit with a driver at a head speed of 50 m/s, and to set a dimple surface coverage above a specific level, the contact area of the ball surface with the club face is increased to ensure excellent spin and control characteristics, and satisfactory dimple effects are exerted to ensure excellent flight performance.

"Effective contact area," as used herein and shown in FIG. 1, refers to the surface area of contact which accurately represents those places on the surface of the ball that actually come into contact with the club face. It excludes the scattered places in the same general region of the ball's surface which do not actually come into contact with the club face, such as dimple recesses. "Apparent contact area," as shown in FIG. 3, is used herein to refer to the entire surface area of the general region of the ball that comes into contact with the club face. This quantity includes scattered places within this region where the surface of the ball does not actually come into contact with the club face, such as dimple recesses. That is, when a circular or elliptical region of the ball contacts the club face, the surface area of this circular or elliptical region is the apparent contact area. Subtracting from this apparent contact area the surface area of those places such as dimple recesses where the surface of the ball does not actually come into contact with the club face yields the effective contact area.

Mention is made of "contact area" in JP-A 7-112036, or example. However, the "contact area" in these patent references denotes the overall surface area computed by such means as elliptical approximation or blacking in of the general region of contact on the ball. This has the same meaning as apparent contact area B used in the present invention, but differs in meaning from effective contact area A as used herein.

More particularly, when a golf ball is actually hit with a club at a certain initial velocity, the feel of the ball to the player is correlated to the contact area of the ball with the club face upon impact as described in JP-A 7-112036 etc. The "contact area" described in these patent references does not accurately represent the area of the ball in close contact with the club face because the dimples which are out of contact with the club face are not taken into account. This contact area corresponds to the apparent contact area B as used herein. The inventor paid attention to the effective contact area of the ball in actual contact with the club face and the apparent contact area as described in the patent references. It has been found that when a golf ball is manufactured such that the ratio of effective contact area A to apparent contact area B may range from 0.40 to 0.60 and the "dimple surface coverage" (the percent of the ball's surface covered by the dimples formed thereon) may be at least 71%, not only spin and control characteristics are improved, but also flight performance is enhanced.

Therefore, the invention provides a golf ball comprising a core and a cover that encloses the core and bearing a number of dimples in its surface. The ball, when hit with a driver having a club face at a head speed of 50 m/s, has an effective contact area A and an apparent contact area B with the club face such that the value of A/B is from 0.40 to 0.60. The ball has a dimple surface coverage of at least 71%.

DETAILED DESCRIPTION OF THE INVENTION

The golf ball of the invention is fabricated such that when the ball is hit with a driver at a head speed of 50 m/s, the ratio A/B between the effective contact area A and the apparent contact area B of the ball at the time of impact is from 0.40/1 to 0.60/1, and preferably from 0.42/1 to 0.58/1. If A/B is less than 0.40, the effective contact area A is insufficient to provide good spin characteristics. At a value of A/B larger than 0.60, the spin characteristics are improved but the distance traveled by the ball decreases.

Figure 1:
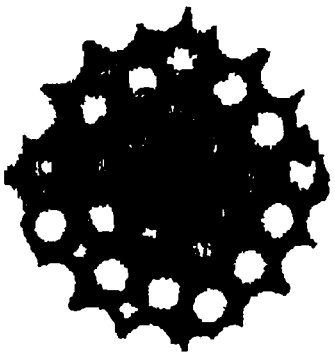
FIG. 1 is an image. illustrating the region of the golf ball that comes into contact with the club face when a golf ball is hit.
Figure 2:
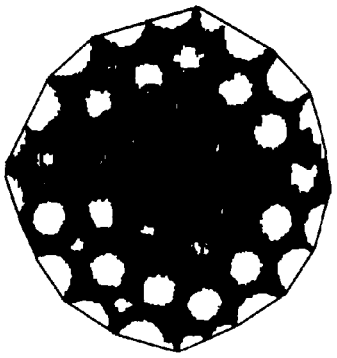
FIG. 2 shows the image in FIG. 1 that has been trimmed.
Figure 3:
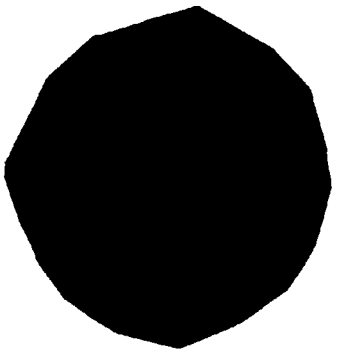
FIG. 3 shows the image in FIG. 2 that has been blacked in for the purpose of determining the apparent contact area B.

The effective contact area A and the apparent contact area B are determined by using pressure-sensitive paper to measure the deformed region when the golf ball is hit. More specifically, measurement is preferably made by the following method which is designed so as to eliminate the influence of score lines on the club face when the ball is hit. To a titanium plate having a weight of 220 g which is shaped as a disk having a diameter of 9 cm and a thickness of 0.8 cm, a pressure-sensitive paper (Fuji Film Prescale pressure-sensitive paper for moderate pressure, manufactured by Fuji Photo Film Co., Ltd.) is affixed. The golf ball is shot with an air cannon against the titanium plate at an initial velocity of 50 m/s. An image of the area of contact by the ball is impressed on the surface of the paper as shown in FIG. 1. As can be seen in FIG. 1, because the normally round dimples are recessed, areas where the surface of ball does not actually contact the club face (the white areas in the diagram) are scattered over the image. The image is then peripherally bounded or "trimmed" to give an approximately circular image, as shown in FIG. 2. The interior of this trimmed image is then completely blacked in as shown in FIG. 3, giving the image used to measure the apparent contact area B.

The effective contact area A and the apparent contact area B can then be computed by scanning the images obtained as described above (FIGS. 1 and 3) into a computer, followed by image processing (digitization). The effective contact area A thus determined is preferably from 1.8 to 3.8 $cm^2$, and especially 1.9 to 3.7 $cm^2$. The apparent contact area B is preferably from 4.5 to 6.3 $cm^2$, and especially from 4.8 to 6.0 $cm^2$. The effective contact area A and apparent contact area B within these ranges must also be such that the ratio A/B is from 0.40 to 0.60. By setting the ratio A/B between 0.40 and 0.60, the dimples near the center of the region of contact on the ball's surface do in fact collapse, so that even those places that are normally dimples come into contact with the club face, increasing the surface area of contact. On the other hand, dimples at the periphery of the region of contact remain in a non-contact state.

A measurement method as described above is used to eliminate the influence of score lines. It has been ascertained that, aside from the presence or absence of score lines, the contact area when a ball is actually hit with a driver and the contact area obtained by this measurement method are in fact the same when the head speed of the driver and the initial velocity are identical. Accordingly, this measurement method provides an acceptable model of the surface area of contact when a golf ball is struck with a driver at a head speed of 50 m/s.

The invention further requires that the dimple surface coverage be at least 71%, and especially at least 73%. A dimple surface coverage of less than 71% fail to provide sufficient dimple effects and hence, excellent flight performance. The upper limit to the dimple surface coverage is generally, though not necessarily, 86%.

The expression "dimple surface coverage" used herein refers to the ratio, expressed as a percentage, of the combined surface area obtained by adding together the area of the planar surface circumscribed by the edge of the opening for each of the many dimples formed on the ball's surface to the area of the imaginary spherical surface that corresponds to the surface of the ball when the dimples are disregarded.

By forming dimples so as to set the ratio of effective contact area A to apparent contact area B between 0.40 and 0.60 and provide a dimple surface coverage of at least 71%, the golf ball is improved in both spin performance and flight performance. As long as these requirements are met, no particular limitation is imposed on the construction and material of the ball. The golf balls of the invention may be either solid golf balls such as two-piece golf balls and multi-piece golf balls composed of three or more layers or wound golf balls. The invention is applicable to any type of golf ball.

The core of the inventive ball may be either a solid core or a thread-wound core and made of known materials. For example, the solid core may be formed of a rubber composition comprising a base rubber, co-crosslinking agent, peroxide and other ingredients as commonly employed in conventional solid cores. Preferably cis-1,4-polybutadiene rubber is used as the base rubber in order to achieve high resilience.

The solid core used herein may be either a single-layer core or a multilayer core. From the standpoint of adjusting the A/B ratio between 0.40 and 0.60, it is preferred that deflection of the core under a static load of 100 kg be set within a range of 2.4 to 3.8 mm, preferably 2.6 to 3.5 mm, and most preferably 2.9 to 3.2 mm. A deflection of less than 2.4 mm indicates a too hard core and may give the ball a hard feel. A deflection greater than 3.8 mm indicates a too soft core and may result in a poor ball resilience and reduced distance and sometimes exacerbate spin characteristics.

From the standpoint of adjusting the A/B ratio between 0.40 and 0.60, it is also preferred to optimize the hardness distribution of the core. Preferably, the core has a JIS-C hardness at the surface of at least 70, more preferably 70 to 95, and most preferably 75 to 93. The core hardness is preferably such that the hardness at the core surface is at least 10 JIS-C units, more preferably 10 to 50 units, most preferably 13 to 40 units, higher than the hardness at the center of the core. A surface JIS-C hardness of less than 70 may sometimes allow the core to be deformed together with the cover when the ball is hit with a club, failing to increase the effective contact area. To increase the effective contact area, it is desired that the cover be given greater deflection or deformation, and the core surface bear this deflection to maintain the quantity of deformation. In this regard, it is preferred that the surface hardness of the core fall within the above JIS-C hardness range. If the difference between surface hardness and center hardness of the core is less than 10 JIS-C hardness units, the ball may have a poor feel. A difference of more than 50 units indicates that the core is too soft at its center and may exacerbate resilience.

The cover enclosing the core may have either a single-layer or multilayer construction. From the standpoint of adjusting the A/B ratio between 0.40 and 0.60, it is also preferred that the cover have a Shore D hardness at the surface of 30 to 62, more preferably 30 to 60, and most preferably 35 to 60. Too low a Shore D hardness may result in poor ball resilience and reduced distance. The cover with a too high Shore D hardness may adversely affect the spin characteristics of the ball. When the cover has a two-layer construction composed of an inner layer and an outer layer, the hardness of the inner layer is not particularly limited and may be determined as appropriate. Where the surface hardness of the core is below the above-mentioned JIS-C hardness range, the cover inner layer should preferably have a JIS-C hardness of at least 70, more preferably 70 to 95, and most preferably 75 to 93.

The cover of the inventive ball may be made of suitable known materials such as ionomer resins and thermoplastic elastomers. The cover has a thickness within a conventional range, preferably from 1.0 to 2.5 mm, more preferably from 1.4 to 2.2 mm, and most preferably from 1.4 to 2.1 mm. Where the cover is composed of two inner and outer layers, it is preferred from the standpoint of adjusting the A/B ratio between 0.40 and 0.60 that the outer layer with a Shore D hardness of 30 to 62 have a thickness of 1.0 to 2.5 mm and especially 1.4 to 2.2 mm.

The cover is formed with a large number of dimples on the surface thereof to provide a dimple surface coverage within the above-defined range. The number of dimples may be set at 360 to 460, and especially 380 to 440. The dimples may all have the same diameter and depth, although dimples may be present in two or more types of differing diameter and/or depth. The dimples may be designed as appropriate as long as the desired ratio of effective contact area A to apparent contact area B is met. It is preferred from the standpoint of adjusting the A/B ratio between 0.40 and 0.60 that the dimples have a diameter of 1.0 to 5.0 mm, and especially 1.0 to 4.8 mm. The arrangement of the dimples is not critical. Use may be made of any suitable known arrangement, such as a regular octahedral, regular dodecahedral or regular icosahedral arrangement.

The golf ball of the invention can be produced by a known method appropriate to the type and construction of the ball. For example, a solid golf ball may be produced by injection molding the cover stock about the core, or by closing a pair of preformed half-cups over the core then molding under heat and pressure.

The diameter, weight and other parameters of the solid golf ball thus obtained may be suitably selected in accordance with the Rules of Golf.

The solid golf ball of the invention has good spin characteristics, especially controllability on approach shots, and excellent flight performance. The inventive golf ball lends itself especially well to use by golfers having a head speed of higher than about 40 m/s.

EXAMPLE

Examples of the invention and comparative examples are given below by way of illustration, and are not intended to limit the invention.

Examples 1–2 and Comparative Examples 1–2

In each Example, the core rubber composition formulated as shown in Table 1 was blended in a kneader and vulcanized in a core mold to form a solid core.

A cover was injection-molded around each of the resulting cores from the respective cover stock materials shown in Table 1, thereby giving solid golf balls for Examples 1 to 2 and Comparative Examples 1 to 2.

At the same time as injection molding, dimples in one of the three sets of configurations shown below in Table 2 (I to III) were formed on the surface of the respective covers.

The physical properties and characteristics of the golf balls obtained in the examples were measured and evaluated as described below. The results are presented in Table 1.

Core Hardness

Measured as the deflection of the core under a static load of 100 kg.

Effective and Apparent Contact Areas A and B

The golf ball was shot with an air cannon against a titanium plate having a weight of 220 g at an initial velocity of 50 m/s. The effective contact area A and apparent contact area B were determined by the method described above using a piece of pressure sensitive paper (Fuji Film Prescale for moderate pressure, manufactured by Fuji Photo Film Co., Ltd.) affixed beforehand to the plate.

Flight Performance

The golf balls in each example were measured for carry and total distance when shot with a driver (No. 1 wood) at a head speed of 50 m/s (HS50) using a swing robot.

Approach Control

The controllability of the ball on approach shots when hit with a pitching wedge was rated as "Excellent," "Good" or "Poor" by five professional and top amateur golfers.

TABLE 1

| Ingredients (parts by weight) | | EX 1 | EX 2 | CE 1 | CE 2 |
|---|---|---|---|---|---|
| Core | cis-1,4-Polybutadiene rubber | 100 | 100 | 100 | 100 |
| | Zinc diacrylate | 30 | 27.5 | 20.5 | 34 |
| | Barium sulfate | 4.5 | 6 | 9.5 | 13.5 |
| | Zinc oxide | 5 | 5 | 5 | 5 |
| | Antioxidant | 0.2 | 0.2 | 0.2 | 0.2 |
| | Dicumyl peroxide | 1.2 | 1.2 | 1.2 | 1.2 |
| Cover | Pandex T-R3080*1 | 100 | 100 | 100 | — |
| | Himilan 7315*2 | — | — | — | 50 |
| | Surlyn 8220*2 | — | — | — | 50 |
| | Titanium white | 5 | 5 | 5 | 5 |
| | Magnesium stearate | 0.3 | 0.3 | 0.3 | 0.3 |
| Core diameter (mm) | | 38.5 | 38.5 | 38.5 | 38.5 |
| Core weight (g) | | 32.8 | 32.8 | 32.8 | 35.3 |
| Core deflection under 100 kg load (mm) | | 2.9 | 3.1 | 4.0 | 2.3 |
| Core surface JIS-C hardness | | 81.6 | 82.0 | 75.1 | 71.0 |
| Core center JIS-C hardness | | 64.8 | 62.3 | 57.0 | 85.0 |
| Cover Shore D hardness | | 38 | 38 | 38 | 67 |
| Ball weight (g) | | 45.3 | 45.3 | 45.3 | 45.3 |
| Dimple set | | I | II | III | I |
| Dimple surface coverage (%) | | 78.0 | 74.5 | 65.0 | 78.0 |
| Effective contact area A ($cm^2$) | | 2.74 | 2.67 | 2.73 | 1.83 |
| Apparent contact area B ($cm^2$) | | 5.24 | 5.40 | 5.73 | 4.78 |
| A/B | | 0.52 | 0.50 | 0.48 | 0.38 |
| Carry (m) at HS50 | | 239.0 | 237.2 | 228.0 | 236.8 |
| Total distance (m) at HS50 | | 255.0 | 252.5 | 245.0 | 253.0 |
| Approach control | | Excellent | Good | Good | Poor |

*1: A thermoplastic polyurethane elastomer by Dai-Nippon Ink & Chemicals Co., Ltd.
*2: An ionomer resin manufactured by Dupont-Mitsui Polychemicals Co., Ltd.
*3: An ionomer resin manufactured by E. I. DuPont de Nemours and Co.

TABLE 2

| Dimples | | | | |
|---|---|---|---|---|
| Set | Diameter (mm) | Number by type | Total number | Dimple surface coverage (%) |
| I | 4.000 | 132 | 432 | 78.0 |
| | 3.700 | 180 | | |
| | 3.200 | 60 | | |
| | 2.850 | 60 | | |
| II | 4.000 | 62 | 432 | 74.5 |
| | 3.700 | 210 | | |
| | 3.200 | 50 | | |
| | 3.100 | 110 | | |
| III | 4.150 | 54 | 360 | 65.0 |
| | 3.600 | 174 | | |
| | 3.450 | 132 | | |

As is apparent from the results in Table 1, the golf balls of Examples 1 and 2 had a good flight performance and were well controllable on approach shots. By contrast, the golf ball obtained in Comparative Example 1 was short in distance because of a small dimple surface coverage despite a value of A/B within the range of invention. The golf ball obtained in Comparative Example 2 was poorly controllable on approach shots because of a smaller value of A/B despite a dimple surface coverage within the range of the invention. Hence, none of the balls obtained in the comparative examples give the advantages of the invention.

Japanese Patent Application No. 11-055238 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising a core and a cover that encloses the core and bearing a number of dimples in its surface, wherein the cover is formed of thermoplastic polyurethane elastomer, and the ball, when hit with a driver having a club face at a head speed of 50 m/s, has an effective contact area A of 1.8 to 3.8 $cm^2$ and an apparent contact area B of 4.5 to 6.3 $cm^2$ with the club face such that the value of A/B is from 0.40 to 0.60, and the ball has a dimple surface coverage of at least 71%.

2. The golf ball of claim 1, wherein the core has a deflection of 2.4 to 3.8 mm under an applied load of 100 kg, and the cover has a Shore D hardness of 30 to 62 at the surface thereof and a thickness of 1.0 to 2.5 mm.

3. The golf ball of claim 1, wherein the ball has an effective contact area A of 1.9 to 3.7 $cm^2$ and an apparent contact area B of 4.8 to 6.0 $cm^2$.

4. The golf ball of claim 1, wherein the value of A/B is from 0.42 to 0.58.

5. The golf ball of claim 1, wherein the core is formed of cis-1,4-polybutadiene rubber.

6. The golf ball of claim 2, wherein the core has a deflection under a static load of 100 kg within a range of 2.6 to 3.5 mm.

7. The golf ball of claim 1, wherein the core has a JIS-C hardness at the surface of 70 to 95.

8. The golf ball of claim 7, wherein the core has a JIS-C hardness at the surface of 75 to 95.

9. The golf ball of claim 1, wherein the core has the hardness at the surface of at least 10 JIS-C units higher than the hardness at the center.

10. The golf ball of claim 9, wherein the JIS-C hardness at the surface of the core is 10 to 50 units higher than the hardness at the center.

11. A golf ball comprising a core and a cover that encloses the core and bearing a number of dimples in its surface; wherein the ball, when hit with a driver having a club face at a head speed of 50 m/s, has an effective contact area A and an apparent contact area B with the club face such that the value of A/B is from 0.40 to 0.60;

the ball has a dimple surface coverage of at least 71%;

the core has a deflection of 2.4 to 3.8 mm under an applied load of 100 kg;

the cover has a Shore D hardness of 30 to 62 at the surface thereof and a thickness of 1.0 to 2.5 mm;

the cover has a two-layer construction composed of an inner layer and an outer layer, and the inner layer has a JIS-C hardness of 75 to 93.

12. The golf ball of claim 1, wherein the dimples have a diameter of 1.0 to 5.0 mm, and are formed at two or more types of differing diameter and/or depth.

13. The golf ball of claim 1, wherein the dimples are set at 360 to 460.

14. A golf ball comprising a core and a cover that encloses the core and bearing a number of dimples in a surface of the cover; wherein the ball, when hit with a driver having a club face at a head speed of 50 m/s, has an effective contact area A of 1.8 to 3.8 $cm^2$ and an apparent contact area B of 4.5 to 6.3 $cm^2$ with the club face such that the value of A/B is from 0.40 to 0.60;

the ball has a dimple surface coverage of at least 71%;

the core has a deflection of 2.4 to 3.8 mm under an applied load of 100 kg;

the cover has a Shore D hardness of 30 to 62 at the surface thereof and a thickness of 1.0 to 2.5 mm;

the core has a JIS-C hardness of 70 to 95 at a surface of the core, and the JIS-C hardness at the surface of the core is 10 to 50 units higher than a JIS-C hardness at a center of the core;

the dimples have a diameter of 1.0 to 5.0 mm, and are formed at two or more types of differing diameter and/or depth; and the dimples are set at 360 to 460.

* * * * *